United States Patent [19]

Sundström

[11] Patent Number: 4,506,444

[45] Date of Patent: Mar. 26, 1985

[54] CHAIN SAW BAR

[75] Inventor: Erik W. Sundström, Sandviken, Sweden

[73] Assignee: Santrade Ltd., Lucerne, Switzerland

[21] Appl. No.: 478,032

[22] Filed: Mar. 23, 1983

[30] Foreign Application Priority Data

Apr. 6, 1982 [SE] Sweden ..... 8202208

[51] Int. Cl.[3] ..... B27B 17/02

[52] U.S. Cl. ..... 30/122; 51/170 R; 144/208 J; 30/384

[58] Field of Search ..... 144/1 E, 1 F, 208 C, 144/208 J; 30/122, 384, 385; 51/170 PT, 181 R, 170 R

[56] References Cited

U.S. PATENT DOCUMENTS

| | | | |
|---|---|---|---|
| 2,489,772 | 11/1949 | Hall . | |
| 2,637,357 | 5/1953 | Johnson | 144/208 C |
| 2,708,468 | 5/1955 | Lantz | 144/208 |
| 2,783,794 | 3/1957 | Kroll | 144/35 |
| 2,821,216 | 1/1958 | West et al. | 144/1 |
| 3,606,707 | 9/1972 | Naslund | 51/170 R |
| 4,063,358 | 12/1977 | Hodge | 30/371 |
| 4,188,987 | 2/1980 | James | 144/194 |
| 4,304,275 | 12/1981 | Glover | 144/208 J |

FOREIGN PATENT DOCUMENTS

| | | | |
|---|---|---|---|
| 199400 | 11/1965 | Sweden . | |
| 7312617 | 9/1973 | Sweden . | |
| 426150 | 12/1982 | Sweden . | |
| 259180 | 6/1949 | Switzerland | 30/384 |
| 604683 | 5/1978 | U.S.S.R. | 30/383 |

*Primary Examiner*—Jimmy C. Peters

*Attorney, Agent, or Firm*—Burns, Doane, Swecker & Mathis

[57] ABSTRACT

Chain saw bar having at its free end a sprocket 20 which supports the saw chain and is rotatably mounted between two side plates (18, 19) in the saw bar on a tubular shaft (26) which is rigidly connected to the sprocket and is adapted to transfer rotation to a driven shaft inserted into the tubular shaft bearing means (24, 25) being arranged in both side plates rotatably supporting the tubular shaft. According to the invention the tubular shaft (26) is short enough to be inserted into a kerf sawed by a saw chain mounted on the saw bar.

7 Claims, 12 Drawing Figures

CHAIN SAW BAR

BACKGROUND AND OBJECTS OF THE INVENTION

The present invention relates to a chain saw bar having at its free end a sprocket supporting the saw chain and being rotatably mounted between two side plates in the saw bar on a tubular shaft, which is rigidly connected to the sprocket and is adapted to transfer rotation to a driven shaft inserted into the tubular shaft, bearing means being arranged in both side plates rotatably supporting the tubular shaft.

A chain saw of the present type consists of a motor unit, inclusive of controls, centrifugal coupling, driving wheel and an electric motor or a combustion motor, a bar unit comprising a bar having a sprocket at the outer end and a chain consisting of drive links, cutter links and side links. The primary field of use for the chain saw is felling and cutting up trees.

The motor unit is a strong power source which is easy to move, properties which render it suitable for many other working tasks, e.g. within agriculture and forestry. It has therefor been proposed to equip the motor unit with different accessory devices for such alternative fields of use. Such accessory devices require the removal of the bar unit and the chain and substitution of other specially designed devices or mounting special drive means parallel with the chain used for sawing. Examples of such constructions are described in U.S. Pat. Nos. 2,489,772, 2,708,468, 2,783,794, 2,821,216 and 4,188,987 and Swedish patent Nos. 87 829, 199400 and 7312617-9.

As distinguished from said prior devices the present invention aims at creating a bar unit which can be used both for its primary purpose, i.e. felling and cutting trees, and be equipped with accessory devices of different kinds. It is possible to attach the accessory equipment to the bar unit without having to change the chain or to remove hoods and other parts from the motor unit. In a bar unit of this type the end sprocket is thin and is surrounded on both sides by the side plates. The thickness of the bearing of the end sprocket is only slightly greater than the thickness of the rest of the bar unit and lies within the width of the saw kerf, so that nothing prevents the saw bar unit from being used for sawing when the accessory equipment is removed.

These and other purposes of the invention have been achieved by making the tubular shaft short enough to be inserted into a kerf made by a saw chain mounted on the saw bar.

THE DRAWING

The invention is described in the following with reference to the appended drawings showing an embodiment examplifying the invention which can be modified within the scope of the claims. The drawings are the following.

FIG. 1, a perspective side view of a chain saw with a saw bar unit according to the present invention, the bar unit being equipped with an accessory device in the form of a grinding wheel.

FIG. 2, a side view of the saw bar unit included in FIG. 1.

FIG. 3, a top view of the saw bar unit in FIG. 2.

FIG. 4, on a larger scale a section through the saw bar unit on the line IV—IV in FIG. 2.

FIG. 5, a portion of the saw chain pertaining to the chain saw.

FIG. 6, the saw bar unit in FIG. 2 provided with a protective cover.

FIGS. 7–11, various designs of the shaft carrying the nose sprocket.

FIG. 12, a longitudinal sectional view through a nose portion of a modified form of chain saw.

DETAILED DESCRIPTION OF PREFERRED EMBODIMENTS OF THE INVENTION

Figure 1:
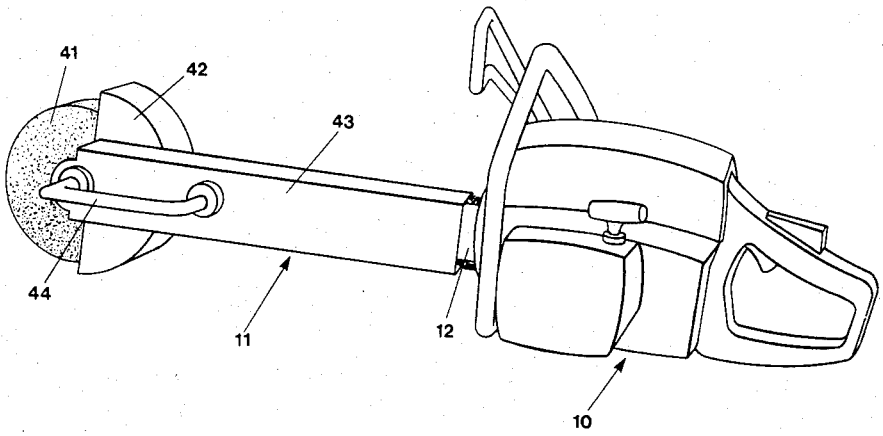
Figure 2:
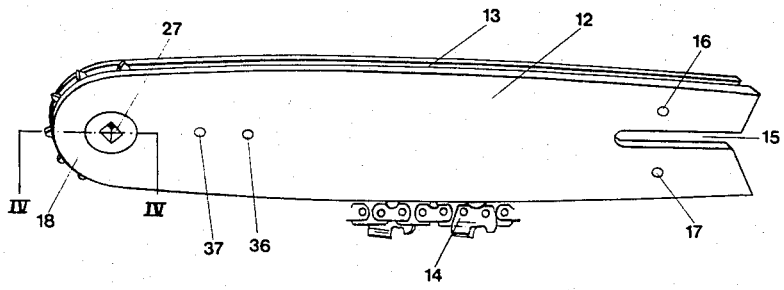
Figure 3:
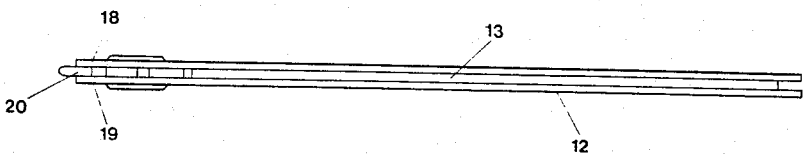
Figure 4:
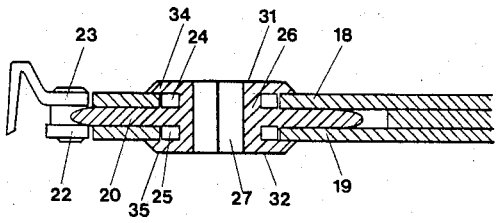
Figure 5:
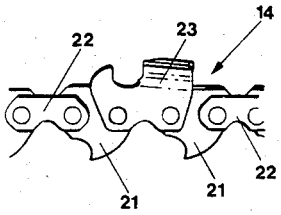
Figure 6:
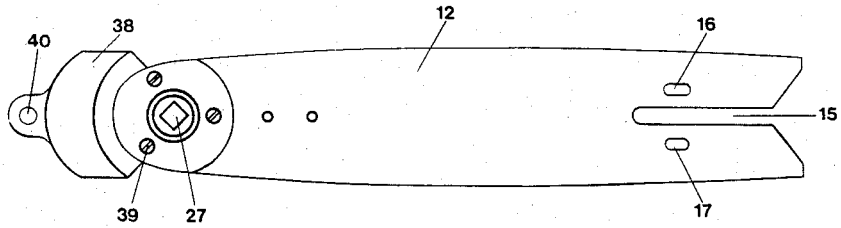
Figure 7:
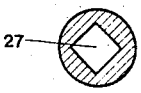
Figure 8:
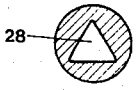
Figure 9:
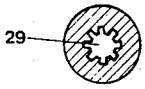
Figure 10:
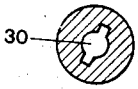

The chain saw illustrated in the drawings comprises a motor unit 10 and a saw bar unit 11. The saw bar unit comprises a saw bar body 12 with a groove 13 for guiding a saw chain 14 moving along the edge of the bar. The saw bar body 12 has at its rear end a slit 15 and holes 16, 17 cooperating with means for fastening the bar in the motor unit 10. At the fore end the saw bar has two side plates 18, 19, between which a toothed nose sprocket 20 is mounted. The teeth of the sprocket 20 carry the drive links 21 of the saw chain 14 in such a way that the side links 22 and cutter links 23 are held somewhat spaced radially from the side plates 18, 19 when they pass around the fore part of the saw bar. The saw bar can be made in one piece or be laminated of a number of plates, usually three. The bar can also be divided by a transverse joint in a fore part and a rear part.

According to the invention there are bearing means, preferably roller bearings 24, 25, mounted in both side plates 18, 19 for rotatable support of a shaft 26 connected to the nose sprocket 20. In the illustrated embodiment the shaft 26 is tubular and its through hole 27 has such a cross section that the shaft can transfer a torque to a driven shaft inserted therein. Besides the quadrangular cross section 27 shown in FIGS. 2, 4, 6 and 7 the hole can be triangular 28, grooved 29 or have one or more wedge grooves 30.

Figure 11:
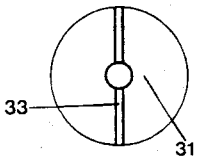

Alternatively the through hole can be cylindrical as in FIG. 11, the end surfaces 31, 32 of the shaft 26 being designed in a suitable way for transferring a torque, for instance by means of radial grooves 33. In order to facilitate mounting of the tubular shaft 26 it is suitable to make the shaft in two parts which are assembled by placing them on each side of the nose sprocket 20 and riveting them together. The rollers in the roller bearings 24, 25 are guided and prevented from falling out by means of flanges 34, 35 which also cover a small zone of the surrounding portion of the side plates 18, 19. The length of the shaft 26 must not exceed the width of the kerf. The surfaces 31, 32 of the shaft are planar and perpendicular to the axis of rotation, and they can be used as support for the rotating components of the attached accessory equipment. It is essential that the parts of the sprocket 20 and the shaft 26 inclusive the flanges 34, 35 and the central bore portion 27 form a rigid unit in order to secure a safe transfer of the power from the sprocket to the attached equipment.

The saw bar 12 is provided with holes 36, 37 extending parallel to the shaft 26 for attachment of the accessory equipment which is being driven by the shaft 26. The saw bar 12 can also be provided with a protective cover 38 along the nose of the bar preventing the saw chain from getting in touch with the workpiece or other objects. This will prevent kick-back of the saw, which is liable to occur when sawing with the nose portion and may cause serious injuries to the person handling the saw. The cover 38 can be detachably fastened to saw bar 12 by means of screws 39 or permanently by welding or as an integral part of the saw bar. The cover 38 has a hole 40 at is outer end for attachment of the accessory equipment. The arc occupied by the cover 38 is about 45° to each side.

In the shown embodiment the accessory equipment is a grinding wheel 41. Numerous other types of equipment can, however, be used with the saw bar according to the invention, e.g. barking devices, hoists, drills and other rotary tools, pumps and wood cleaving machines.

Figure 12:
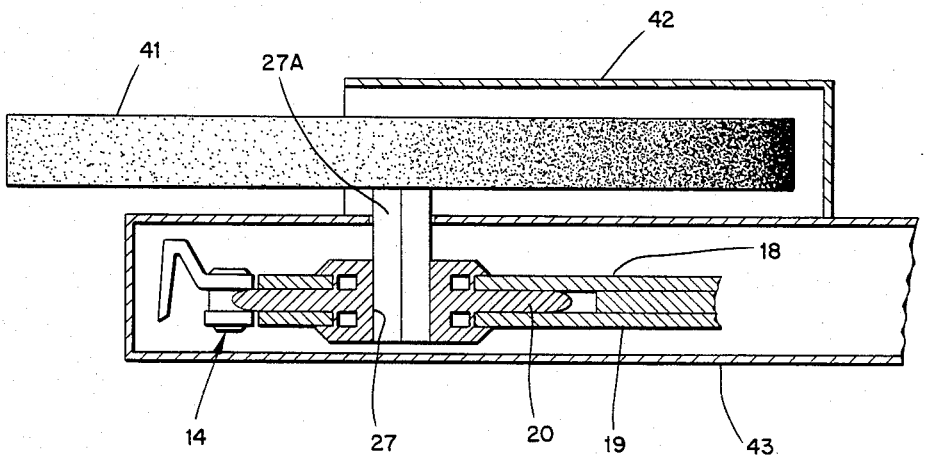

In the illustrated embodiment the grinding wheel 41 is protected by a cover 42. The saw bar is enclosed in a protective sleeve 43 which prevents contact with the moving chain. A handle 44 with threaded ends is mounted in hole 40 and one of holes 36 and 37. The cover 42 is fastened on the ends of handle 44. The grinding wheel is mounted on a shaft (such as the square shaft 27A of FIG. 12) going through hole 27.

The invention makes is possible to use the same saw bar both for sawing and for driving an accessory device. In the latter case the chain performs a purely driving function and should be protected as described in order not to expose persons and objects to the risks always involved with a moving saw chain. The cover 43 along the saw bar is for this purpose important when using the saw machine for driving accessory devices, but the cover 43 must of course be removed when using the saw bar for sawing. The cover 38 is intended in the first place for sawing but can also be retained and used in combination with the cover 43 in use for driving. If the cover 38 is removed the cover 43 can be modified so that it surrounds also the nose portion as depicted.

I claim:

1. Saw bar in a motor-driven chain saw, said saw bar having at its free end a sprocket supporting a saw chain and being rotatably mounted between two side plates in the saw bar on a tubular shaft such that said saw chain transmits rotary motion from a motor to said sprocket, said shaft being rigidly connected to the sprocket and is adapted to transfer rotation to a driven shaft inserted into a through-hole in the tubular shaft for driving an auxiliary tool, bearing means being arranged in both side plates rotatably supporting said tubular shaft, said tubular shaft having opposite ends disposed substantially flush with said side plates so that said shaft is short enough to be inserted into a kerf sawed by the saw chain.

2. Saw bar as defined in claim 1, characterized in that the tubular shaft has end flanges forming annular recesses in the sprocket in which said bearing means in the form of bearing rollers are inserted, the flanges covering a portion of the side plates around said rollers.

3. Saw bar as defined in claim 1 characterized in that the saw chain is substantially surrounded by a conveyor a front end of said cover surrounding a portion of said saw chain passing around said sprocket.

4. Saw bar as defined in claim 2, characterized in that the saw chain is substantially surrounded by a cover.

5. A chain saw in combination with an auxiliary tool driven by said chain saw, comprising:

a housing;

a motor carried by said housing;

a saw bar connected at one end to said housing, said saw bar including a pair of parallel side plates;

a nose sprocket disposed between said side plates at an opposite end of said saw bar, said sprocket comprising:

a toothed portion projecting beyond peripheral edges of said side plates, and a hollow shaft portion rigidly joined to said toothed portion for rotation therewith, said hollow shaft portion having opposite ends arranged substantially flush with said side plates;

bearing means in said side plates for rotatably supporting said hollow shaft portion;

a saw chain extending around said saw bar and connected to said motor and said toothed portion to transmit rotary motion from the former to the latter, and an auxiliary tool having a drive shaft mounted in a through-hole extending through said hollow shaft portion for rotation with said sprocket such that said saw chain transmits rotary motion from said motor to said sprocket, and said sprocket rotates said auxiliary tool.

6. The combination according to claim 5, including a cover extending around a substantial portion of said saw bar and saw chain including the portion of said saw chain passing around said nose sprocket.

7. The combination according to claim 5, wherein said ends of said hollow shaft project slightly beyond said side plates.

* * * * *